US005611681A

United States Patent [19]

Everitt

[11] Patent Number: 5,611,681

[45] Date of Patent: Mar. 18, 1997

[54] RECIPROCATING ROD TYPE PUMP FOR SHEAR SENSITIVE MATERIAL

[75] Inventor: David G. Everitt, Solihull, Great Britain

[73] Assignee: Hydrair Limited, England

[21] Appl. No.: 417,757

[22] Filed: Apr. 6, 1995

[51] Int. Cl.[6] ..... F04B 15/02

[52] U.S. Cl. ..... 417/569; 417/DIG. 1; 137/533; 84/24

[58] Field of Search ..... 417/569, DIG. 1, 417/900; 137/532, 533, 534; 184/24

[56] References Cited

U.S. PATENT DOCUMENTS

| | | | |
|---|---|---|---|
| 581,469 | 4/1897 | Mills | 417/569 |
| 1,294,014 | 2/1919 | Worster | 137/533 |
| 1,971,542 | 8/1934 | Taylor | 184/24 |
| 3,330,217 | 7/1967 | Baur et al. | 417/454 |
| 4,014,629 | 3/1977 | Elsworth . | |
| 4,140,442 | 2/1979 | Mulvey . | |
| 4,260,342 | 4/1981 | Leka . | |
| 4,285,642 | 8/1981 | Komhyr | 417/465 |
| 4,349,321 | 9/1982 | Bentley . | |
| 4,432,386 | 2/1984 | Pacht . | |
| 4,456,439 | 6/1984 | Wolff . | |
| 5,092,609 | 3/1992 | Balzano . | |

FOREIGN PATENT DOCUMENTS

| | | | |
|---|---|---|---|
| 0317716 | 5/1988 | European Pat. Off. . | |
| 9308066 | 9/1993 | Germany . | |
| 210212 | 7/1960 | Sweden | 417/569 |
| 8601260 | 2/1986 | WIPO . | |
| 9507412 | 3/1995 | WIPO . | |

*Primary Examiner*—Timothy Thorpe
*Assistant Examiner*—Roland G. McAndrews, Jr.
*Attorney, Agent, or Firm*—Bernard L. Kleinke; Peter P. Scott

[57] ABSTRACT

A pump for pumping shear sensitive material comprising a housing having an internal displacement chamber and a displacement rod. The displacement rod is reciprocable within the displacement chamber and the displacement chamber having an aperture through which the displacement rod is reciprocated. The aperture being sealed with respect no the displacement chamber by the displacement rod and an annular seal surrounding the displacement rod. The displacement chamber having an inlet opposite the aperture and an outlet radially disposed to the longitudinal axis of the displacement rod and in close proximity to the annular seal.

13 Claims, 2 Drawing Sheets

RECIPROCATING ROD TYPE PUMP FOR SHEAR SENSITIVE MATERIAL

BACKGROUND OF THE INVENTION

1. Field of the Invention

The present invention relates to pumps for pumping shear sensitive material, and in particular, but not exclusively, to pumps for pumping viscous fluids which are prone to set if subjected to high frictional forces.

One such viscous fluid is UV ink, which is an ink of a high viscosity which cures when subjected to ultra violet radiation. The properties of the UV ink which enable it to set when it is irradiated unfortunately render it very sensitive to friction. Viscous fluids require the build up of a high pressure in order that they can be pumped.

2. Description of the Prior Art

A pump is known which provides very little frictional force on the material being pumped and that is a double diaphragm pump; such pumps do not have sliding surface between which the material to be pumped travels and therefore there is little chance of a high frictional force being generated which will cure the material. However, due to the inherent limitation of the flexible diaphragm material employed, such pumps are restricted to low pressure applications, that is up to about 13.6 atmospheres (200 psi) Therefore, such pumps are unsuitable for pumping material of a high viscosity.

Single and double acting pumps can each provide the required pressure to pump viscous fluids.

Both double acting pumps and some single acting pumps have a piston which is reciprocated between an inlet and an outlet such that fluid is forced from below the piston to above the piston during a pumping cycle.

In a double acting pump fluid is forced between two separate chambers in the pump, the piston doubles as a valve between the chambers and the fluid is Forced through small apertures which open between the two chambers during displacement of the piston. In some types of single acting pump the piston has several small apertures through which the fluid is forced, during the reciprocating movement of the piston,in order to move fluid from the inlet to the outlet. Each of the above pumps therefore have the drawback that the small clearances and the meshing of several opposing surfaces, can produce a high frictional force on the fluid being pumped which enable shear sensitive materials such as UV ink to cure within the pump and consequently block the pump and prevent it operating.

In a further known type of single acting pump, used for pumping light viscosity fluids, such as hydraulic oil, a displacement rod is reciprocated within a displacement chamber, by which means fluid is drawn in through the inlet into the displacement chamber on one cycle of the rod and from the displacement chamber out through the outlet on the other cycle of the displacement rod. However, if such pumps are used to pump highly viscous fluids, voids form in the displacement chamber, thereby making them unsuitable for pumping such fluids.

It is an object of the present invention to provide a pump which overcomes, or alleviates, the aforementioned problems.

SUMMARY OF THE INVENTION

In accordance with the present invention there is provided a pump for pumping shear sensitive material, comprising a housing having an internal displacement chamber and a displacement rod reciprocable within the displacement chamber, the displacement chamber having an aperture through which the displacement rod is reciprocated, the aperture being sealed with respect to the displacement chamber by the displacement rod and an annular seal surrounding the displacement rod, the displacement chamber also having an inlet opposite the aperture, and an outlet substantially radially disposed to the longitudinal axis of the displacement rod and in close proximity to the annular seal.

Unlike the conventional double acting reciprocating pump and the conventional single acting reciprocating pump, the above pump has only one true region of friction within the fluid area and this is between the seal and the displacement rod. However, whereas the known pumps have areas within the fluid that have small radial gaps, this design of pump allows a large volume of constantly changing fluid to surround the seal, thanks to the close proximity of the outlet to the seal. This alleviates the shear that takes place due to the build up of frictional heat as per the known pumps, when the material to be pumped is forced through the piston or about the piston, by the piston being replaced by the displacement rod and the inlet and outlet being on the same side, ie, contacting the same displacement chamber. Furthermore, the close proximity of the outlet to the annular seal alleviates the build up of voids in the fluid.

Preferably, the displacement rod is made of metal, more preferably stainless steel.

Preferably, the displacement rod is made of a non stick material or is coated in a non-stick material such as plastics. This has the advantage that the adhesion of the fluid to the displacement rod is reduced and therefore the frictional force on the material to be pumped is reduced.

Preferably, the inlet and/or outlet has a valve having a substantial flat surface opposite its valve seat. This has the advantage that a large surface area is facing the fluid when it acts on the valve to push it closed against its valve seat, this ensures that the valve closes quickly and does not leave a small radial gap through which the fluid, when forced, would create shearing of the fluid.

Preferably, the or each valve seat is conical and the surface of the valve which mates with the valve seat is rounded. This has the advantage that the valve more accurately closes on to its seat reducing the possibility of radial gaps forming. Preferably, a stop is provided to limit the opening of the or each valve. This ensures that the valve is not forced away from the valve opening and thereby prevented from reseating.

Preferably, the or each valve is weighted. This ensures that the valve accurately reseats.

Preferably, the outlet has an outlet valve for opening and closing the outlet, the longitudinal axis of the outlet valve being substantially parallel to the longitudinal axis of the displacement rod and the exit to the outlet being in the longitudinal plane of the valve.

Preferably, the annular seal comprises two or more separate seals. This prevents any ingress of material beyond the primary seal during the filling of the pump.

Preferably, the displacement rod has a speed regulator which regulates the speed of the upward stroke of the displacement rod from the displacement chamber. This has the advantage that the suction force created by the upward movement is regulated, so that the rod is only displaced as fast as material can enter through the inlet into the displacement chamber, thus avoiding voids occurring in the displacement chamber which would reduce the pumping efficiency.

Preferably, the pump has a chamber for solvent and/or lubricating fluid through which the reciprocating displacement rod passes at the opposite side of the annular seal to the displacement chamber. This has the advantage that fluid in the chamber wets the displacement rod as it leaves the displacement chamber, this helps to prevent any small traces of pumped fluid that escapes past the displacement rod seals curing.

BRIEF DESCRIPTION OF THE DRAWINGS

By way of example only the invention will now be described, with reference to the accompanying drawing, in which.

DETAILED DESCRIPTION OF THE INVENTION AND PREFERRED EMBODIMENTS THEREOF

Figure 1:
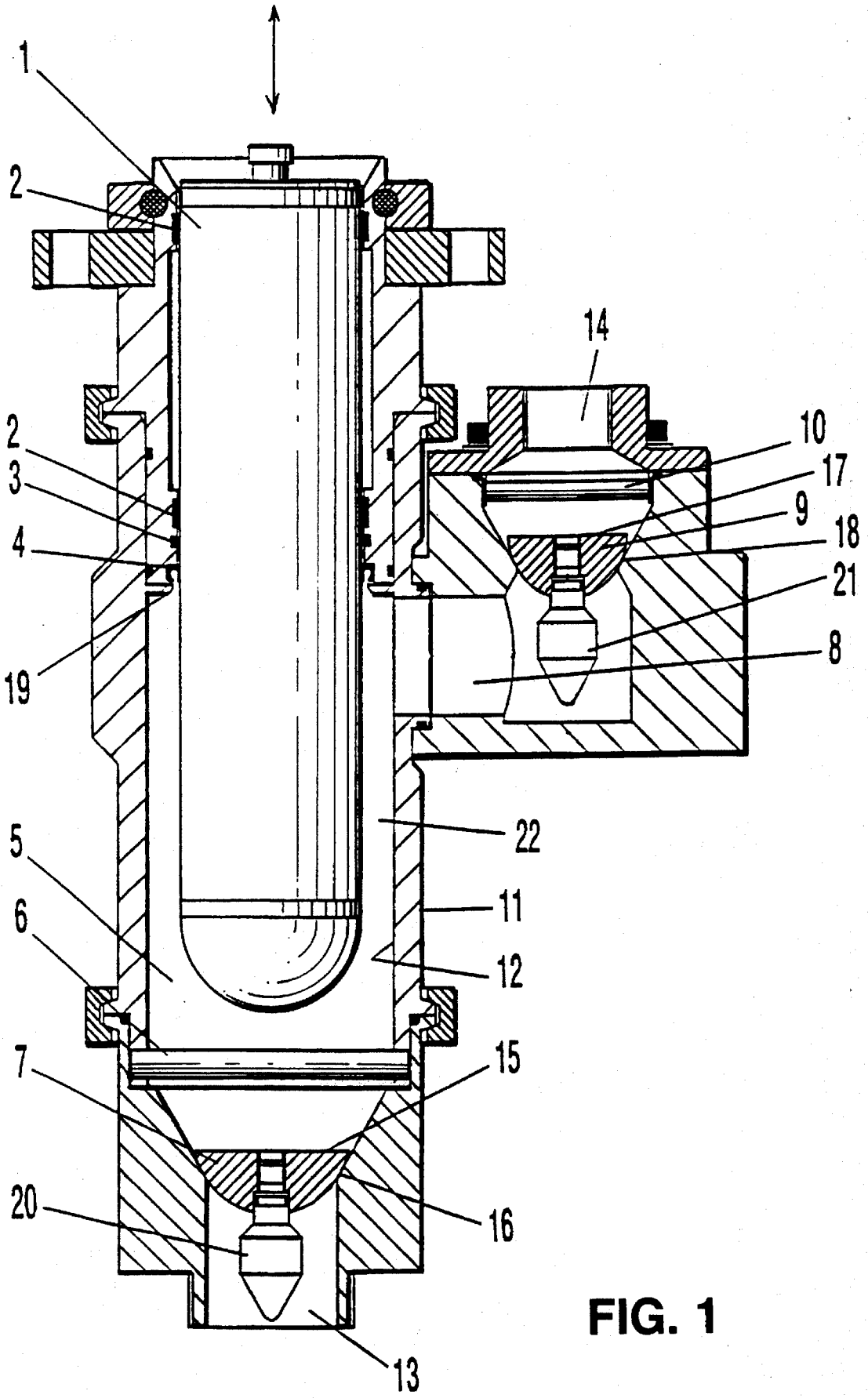
FIG. 1 is a longitudinal partial sectional view through a pump constructed in accordance with a first embodiment of the present invention.

As shown in FIG. 1, the pump for pumping shear sensitive material comprises a housing 11 having an internal bore 12 in which a displacement rod 1 is reciprocated by means of a pump actuator (not illustrated). The displacement rod 1 delimits within the bore 12 a displacement chamber 5.

The housing 11 has an inwardly projecting shoulder 19 on which is carried a primary seal 4, secondary seal 3 and a bearing 2, each of which contact the outer surface of the displacement rod 1. The displacement chamber 5 is sealed towards the actuator by the seals 3,4. The displacement rod 1 bears against the shoulder 19 by bearing 2. An annular gap 22 surrounds the displacement rod 1 within the bore 12.

The pump housing 11 has an inlet 13 having an inlet valve 7 and an outlet having an outlet valve 9.

The inlet valve 7 comprises a flat surface 15 facing the displacement rod 1 which delimits, together with the displacement rod 1, the displacement chamber 5 within the bore 12 of the housing 11. The remaining surface of the valve is rounded and has a dependent bob weight 20. When the inlet 13 is closed the rounded surface of the inlet valve 7 is seated against a valve seat 16 formed by a narrowed portion of the bore 12 of the housing 11.

The outlet 14 comprises an outlet chamber 8 located radially to the longitudinal axis of the pump. Within the outlet chamber a outlet valve 9 acts to open and close the outlet, for this purpose and similar to the inlet valve 7, the outlet valve 9 comprises a flattened end surface 17 facing outwardly from the outlet chamber and an outlet valve bob weight 21, dependent from the rounded surface of the inlet valve which faces into the outlet chamber 8. The rounded surface of the outlet valve rests against valve seat 18 to close the outlet.

A stop pin 6,10 is provided at the inlet end and outlet end to limit the upward travel of the inlet and outlet valves 7,10 from their respective seats 16,18.

The narrowed portion of the bore 12 of the housing 11 has a conical surface and together with the rounded surface of the inlet valve 7 provide for accurate seating of the inlet valve 7 on the valve seat 16. Likewise the outlet of the outlet chamber 8 has a conical surface to enable accurate seating of the outlet valve 9 on valve seat 18 at the outlet 14.

In use the pump actuator reciprocates the displacement rod 1 upwards, this creates a void in the displacement chamber 5, the force of which lifts the inlet valve 7 from its seat 16 allowing fluid to be sucked through the inlet 13 into the displacement chamber 5. The displacement rod 1 continues upward to the end of its stroke, drawing in fluid behind it. The displacement rod 1 now starts to descend. As fluid is no longer being drawn through the inlet valve 7 it starts to sink through the fluid under gravity.

In addition to gravity the large flat area 15 on top of the inlet valve 7 is subject to a downward force from the fluid being displaced by the displacement rod 1, which helps to close the inlet valve 7. Once the inlet valve 7 is closed, fluid in the displacement chamber 5 is displaced by the descending displacement rod 1 into the outlet valve chamber 8. The build up of fluid in the outlet chamber 8 lifts the outlet valve 9 from its seat 18 and opens the outlet 14, the fluid then passes through the outlet by virtue of the downward movement of the displacement rod 1.

When the displacement rod 1 reaches the end of its downward stroke and is therefore no longer displacing fluid, gravitation forces and fluid pressure in the outlet chamber acting on the large flat area 17 on top of the outlet valve 9 causes the outlet valve 9 to close.

Because the volume of the displacement chamber 5 is larger than the displacement volume of the displacement rod 1 the initial filling of the displacement chamber 5 with fluid may take several cycles when the pump is empty and therefore the outlet valve chamber 8 is as close as possible to the primary seal 4, so that any air in the pump is rapidly displaced. The secondary seal 3 acts to prevent air being sucked past the primary seal 4 during the upward stroke.

Figure 2:
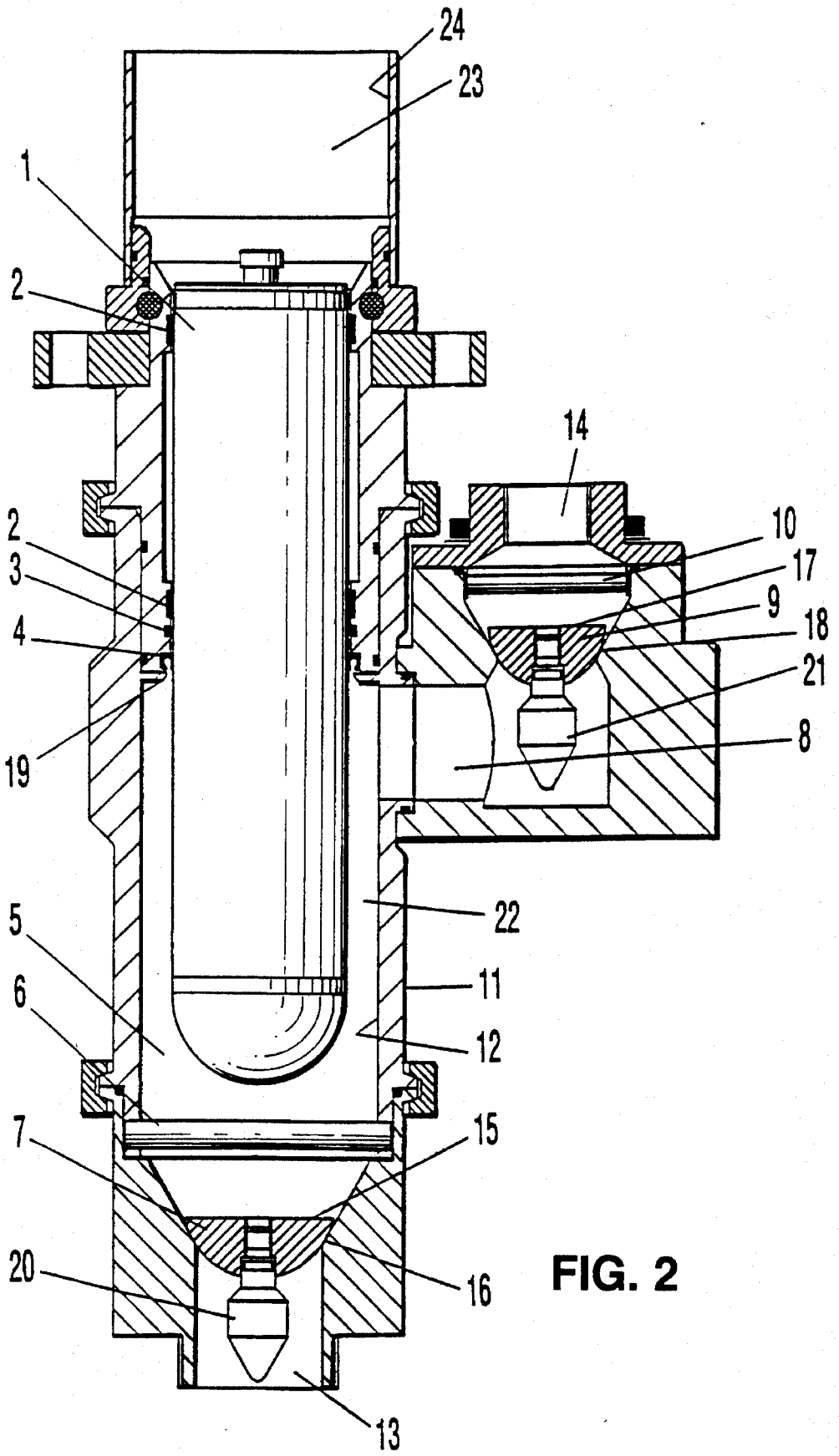
FIG. 2 is a longitudinal partial sectional view through a pump constructed in accordance with a second embodiment of the present invention.

In the second embodiment of the pump illustrated in FIG. 2, the pump of FIG. 1 is modified to incorporate a chamber 23 attached to the end of the pump housing 11 remote from the inlet 13 and above the primary and secondary seals 4,3. In use, the chamber 23 is filled with a fluid (such as a solvent or a lubricant or a combination of both) such that a level is maintained against the chamber wall 24. The fluid in the chamber will gradually seep past the bearings 2 until it reaches the secondary seal 3. The secondary seal 3 acts to prevent fluid from the chamber being sucked past the primary seal 4 during the movement of the displacement rod. The fluid in the chamber 23 wets the displacement rod 1 as it leaves the displacement chamber 5.

To ensure that the displacement rod 1 does not travel upwards on its upwards stroke faster than the fluid can enter the displacement chamber 5, the pump actuator may be provided with an independent speed regulator or restrictor. On the downward cycle of the displacement rod the pump actuator is having to work proportionally to the effort of pushing fluid out of the outlet and therefore a speed restrictor is not required on the downward stroke. For an actuator such as an air motor the speed regulation can be achieved by restricting the flow on the exhaust.

The displacement rod can be made of metal for example stainless steel. To provide less adhesion of the fluid to the displacement rod 1 and so less shear, the displacement rod could have a plastic coating, such as the plastic coating sold under the trademark PTFE (Trade Mark) or ACETAL (Trade Mark).

The inlet and/or outlet valve can be made from metal or plastics depending on the nature of the fluid to be pumped. The inlet and/or outlet valve bob weight can be made of metal and be of a size and shape to suit the viscosity of the fluid to be pumped.

Further numerous modifications and changes will readily occur to those skilled in the art.

The above description is not meant to describe in detail each and every modification and variation which will be apparent to a person skilled in the art. It is however, meant to include all such modifications and variations with the scope of the following claims.

What is claimed is:

1. A reciprocating rod type pump for pumping shear sensitive material, comprising a housing having an internal displacement chamber, and a displacement rod reciprocable within the displacement chamber, the displacement rod having a longitudinal axis, the displacement chamber having an aperture through which the displacement rod is reciprocated, the aperture being sealed with respect to the displacement chamber by the displacement rod and an annular seal surrounding the displacement rod, which annular seal faces and forms a direct potion of the displacement chamber, the displacement chamber also having an inlet opposite the aperture, and an outlet substantially radially disposed to the longitudinal axis of the displacement rod and in close proximity to the annular seal, wherein the outlet has an outlet valve for opening and closing the outlet, the outlet valve having a longitudinal axis, the inlet having an inlet valve for opening and closing the inlet, the longitudinal axis of the outlet valve being substantially parallel to the longitudinal axis of the displacement rod and an exit of the pump from to the outlet valve being in the longitudinal axis of the outlet valve.

2. A pump as claimed in claim 1, wherein the displacement rod is made of metal.

3. A pump as claimed in claim 2, wherein the metal is stainless steel.

4. A pump as claimed in claim 1, wherein the displacement rod is made of a non-stick material.

5. A pump as claimed in claim 1, wherein the inlet valve has a substantially flat surface opposite its valve seat.

6. A pump as claimed in claim 5, wherein the valve seat is conical and the surface of the valve which mates with the valve seat is rounded.

7. A pump as claimed in claim 5, wherein a stop is provided to limit the opening of the valve.

8. A pump as claimed in claim 1, wherein the outlet valve has a substantially flat surface opposite its valve seat.

9. A pump as claimed in claim 8, wherein the valve seat is conical and the surface of the valve which mates with the valve seat is rounded.

10. A pump as claimed in claim 8, wherein a stop is provided to limit the opening of the valve.

11. A pump as claimed in claim 1, wherein the annular seal comprises at least two separate seals.

12. A pump as claimed in claim 1, further comprising a chamber for solvent through which the reciprocating displacement rod passes at the opposite side of the annular seal to the displacement chamber.

13. A pump as claimed in claim 1, further comprising a chamber for lubricating fluid through which the reciprocating displacement rod passes at the opposite side of the annular seal to the displacement chamber.

* * * * *

UNITED STATES PATENT AND TRADEMARK OFFICE

CERTIFICATE OF CORRECTION

PATENT NO : 5,611,681

DATED : March 18, 1997

INVENTOR(S) : David G. Everitt

It is certified that error appears in the above-identified patent and that said Letters Patent is hereby corrected as shown below:

On title page,
Item 57, line 8, delete "no", and substitute therefor --to--.

Item 56, under "FOREIGN PATENT DOCUMENTS", third patent listed, delete "Sweden", and substitute therefor Column 5, line 18, delete "potion", and substitute therefor --portion--.

Signed and Sealed this

Seventh Day of October, 1997

*Attest:*

Bruce Lehman

BRUCE LEHMAN

*Attesting Officer*

*Commissioner of Patents and Trademarks*